US011359449B2

(12) United States Patent
Hardesty

(10) Patent No.: US 11,359,449 B2
(45) Date of Patent: Jun. 14, 2022

(54) CONTROLLED TIMING OF ACTUATED PLUG ELEMENT AND METHOD

(71) Applicant: GEODYNAMICS, INC., Millsap, TX (US)

(72) Inventor: John T. Hardesty, Fort Worth, TX (US)

(73) Assignee: GEODYNAMICS, INC., Millsap, TX (US)

( * ) Notice: Subject to any disclaimer, the term of this patent is extended or adjusted under 35 U.S.C. 154(b) by 288 days.

(21) Appl. No.: 16/437,147

(22) Filed: Jun. 11, 2019

(65) Prior Publication Data

US 2019/0292868 A1 Sep. 26, 2019

Related U.S. Application Data

(63) Continuation of application No. 16/134,147, filed on Sep. 18, 2018, now Pat. No. 10,358,885.

(60) Provisional application No. 62/598,071, filed on Dec. 13, 2017, provisional application No. 62/587,592, filed on Nov. 17, 2017.

(51) Int. Cl.

| | |
|---|---|
| ***E21B 29/02*** | (2006.01) |
| ***E21B 47/06*** | (2012.01) |
| ***E21B 33/12*** | (2006.01) |
| ***E21B 41/00*** | (2006.01) |
| *E21B 43/26* | (2006.01) |

(52) U.S. Cl.

CPC ..... *E21B 29/02* (2013.01); *E21B 33/12* (2013.01); *E21B 41/00* (2013.01); *E21B 47/06* (2013.01); *E21B 43/26* (2013.01)

(58) Field of Classification Search

CPC ..... E21B 29/02; E21B 33/12; E21B 41/00; E21B 47/06; E21B 43/26

See application file for complete search history.

(56) References Cited

U.S. PATENT DOCUMENTS

| | | | |
|---|---|---|---|
| 2012/0181032 A1 | 7/2012 | Naedler et al. | |
| 2013/0062055 A1 | 3/2013 | Tolman et al. | |
| 2014/0158356 A1 | 6/2014 | Andrzejak et al. | |
| 2015/0136396 A1 | 5/2015 | Turley et al. | |
| 2015/0184486 A1 | 7/2015 | Epstein | |
| 2015/0247084 A1 | 9/2015 | Epstein | |
| 2015/0337615 A1 | 11/2015 | Epstein et al. | |
| 2016/0047199 A1 | 2/2016 | Hardesty et al. | |
| 2016/0130906 A1* | 5/2016 | Garvey | E21B 33/12 166/376 |

(Continued)

FOREIGN PATENT DOCUMENTS

WO 2017100417 A1 6/2017

OTHER PUBLICATIONS

International Search Report and Written Opinion, dated Nov. 19, 2018, from corresponding/related PCT Application No. PCT/US18/51458.

*Primary Examiner* — Yong-Suk (Philip) Ro

(74) *Attorney, Agent, or Firm* — Morgan, Lewis & Bockius LLP

(57) ABSTRACT

A ball for sealing a plug in a well, the ball including a body; an actuation mechanism located in the body and configured to break the body into parts; and a ball sensor located on the body and configured to activate the actuation mechanism. The ball sensor is configured to measure a parameter that is generated by a tool sensor, which is located on a downhole tool.

34 Claims, 19 Drawing Sheets

(56) References Cited

U.S. PATENT DOCUMENTS

| | | | | |
|---|---|---|---|---|
| 2017/0159397 | A1 | 6/2017 | Tolman et al. | |
| 2019/0249520 | A1 * | 8/2019 | Merron | E21B 43/25 |

* cited by examiner

CONTROLLED TIMING OF ACTUATED PLUG ELEMENT AND METHOD

BACKGROUND

Technical Field

Embodiments of the subject matter disclosed herein generally relate to downhole tools related to perforating and/or fracturing operations, and more specifically, to an actuated plug element and associated method for controlling an actuation timing of the plug element.

Discussion of the Background

Once a well 100 is drilled to a desired depth H relative to the surface 101, as illustrated in FIG. 1, and the casing 102 protecting the wellbore 104 has been installed and cemented in place, it is time to connect the wellbore 104 to the subterranean formation 106 to extract the oil and/or gas.

The process of connecting the wellbore to the subterranean formation may include the following steps: (1) placing a plug 110 with a through port 112 (known as a frac plug) above a just stimulated stage 104A, (2) perforating the new stage 104B above the plug 110, (3) dropping a ball 120 to seal the frac plug 110 after the perforation is successfully completed, and (4) fracturing the new stage 104B by pumping from the surface a slur 113 with a pump 114.

Once all of the stages 104A, 104B, etc. are completed, the plugs 110 and balls 120 (only one is shown in the figure for simplicity, but those skilled in the art would know that each stage has its own plug and ball) are milled out of the well during a "cleanout run." Then, the well 100 can be brought into production.

The cleanout run takes time and skill, which add to the cost of operating the well. Thus, it is desirable to bring the well onto production without having to complete a cleanout run or with a shorter cleanout run. A solution to this problem is a special ball that is configured to "disappear" (i.e., degrade) after a certain time period, so that problems where the well is unable to take fluid injection into the new stage can be resolved by opening access to the recently stimulated next stage down. Degradable materials used for this special ball, called herein "degradable ball," appeared initially to be able to fill the role of not completing the cleanout run, but since their introduction they have proven to be unreliable.

For example, as illustrated in FIG. 2, after the ball 120 is in place, sand and other debris 122 generated during the perforation stage accumulates upstream the ball. As the time passes, the ball degrades, changing its shape as illustrated in FIG. 3. However, the ball is still blocking the passage 112 through the plug 110, which is undesirable.

More recently, a more reliable "actuated" ball (or plugging element) has been proposed. The actuated ball includes an internal mechanism that can be activated by changing a pressure or another parameter of the well. As a result of the actuation of the ball, a time delay is triggered after which the ball is broken up into parts, typically by an explosion. The time delay is a time that is considered to be safe for the well, i.e., after all the necessary operations associated with the fracturing of the well have been performed. For example, the time delay is about 8 h.

FIG. 4 shows this situation, when the original ball 120 has been actuated and broken into parts. FIG. 4 shows a small part 120A of the original ball 120 being left intact, and various fragments of the ball and sand have formed precipitates 124. These precipitates are formed as now discussed. If the original ball was made with a degradable material, that material, in order to degrade, needs at least a reactant (e.g., the water in the well) for completing the degradation reaction. Due to the sand 122 deposited above the ball during the fracturing operation, the reaction of the ball with the reactant is starved of the reactant because of the aspect ratio of the well (if a large bore is used, the ratio of the diameter of the ball and the diameter of the well is large), and the displacement of the water by the packed sand. In addition, because the product of the degradation reaction (for example, MgOH) is dissolved in water, which then becomes over saturated, this product precipitates out into the sand, and can cement this sand together into a secondary plug 124, which then continue to block the plug 110 although the ball has been broken into parts. The same problem is found for polymer-based degradable elements as they create a gel byproduct which can glue the sand together.

Thus, although the ball 120 is degradable and supposed to "disappear" after a certain time, the precipitates 124 left by the degradation reaction act as a new ball and they need to be removed with a coil operation. If an actuated ball is used, because the actuated ball combines a degradable ball with an actuating mechanism, the same precipitates may form in one or more stages upstream the plug, still blocking the plug.

Therefore, with the existing balls and technology, it is not straight-forward to remove the ball to achieve an open port 112 at a desired time, unless further cleanout operations are carried out, which is undesirable.

Thus, there is a need to provide a better ball and method that can open the port of the plug at a desired time during the fracturing process.

SUMMARY

According to another embodiment, there is a ball for sealing a plug in a well. The ball includes a body, an actuation mechanism located inside the body and configured to break the body into parts, and a sensor connected to the actuation mechanism and configured to measure a parameter outside the body. The actuation mechanism includes a first timer that is triggered by a first measured value of the parameter, and also includes a second timer that is triggered by a second measured value of the parameter.

According to another embodiment, there is a ball for sealing a plug in a well. The ball includes a body, an actuation mechanism located inside the body and configured to break the body into parts, a first sensor connected to the actuation mechanism and configured to measure a first value of a parameter outside the body, and a second sensor connected to the actuation mechanism and configured to measure a second value of the parameter outside the body. The actuation mechanism includes a first timer that is triggered by the first sensor, and also includes a second timer that is triggered by the second sensor.

According to still another embodiment, there is a method for breaking a ball. The method includes selecting up a hydrostatic pressure corresponding to a depth in a well where the ball is intended to be deployed; selecting up a trigger pressure, which is larger than a fracturing pressure to be applied to the ball while in the well; releasing the ball into the well; measuring a well pressure with a first sensor when the ball has reached a corresponding plug; actuating a first timer inside the ball when the measured pressure is equal to or larger than the hydrostatic pressure, the first timer counting a first time period; applying the trigger pressure to the well while the first timer is still counting; actuating a second timer inside the ball when the measured pressure is equal to or larger than the trigger pressure, the second timer counting a second time period; and actuating, at the end of the second time period, an energetic material (508) located inside an internal chamber of the ball to break the ball into parts. The hydrostatic pressure is a pressure exerted by a fluid in the well at a location of the ball, and the trigger pressure is a pre-determined pressure, higher than the hydrostatic pressure.

According to still another embodiment, there is a ball for sealing a plug in a well. The ball includes a body, an actuation mechanism located in the body and configured to break the body into parts, and a ball sensor located on the body and configured to activate the actuation mechanism. The ball sensor is configured to measure a parameter that is generated by a tool sensor, which is located on a downhole tool.

According to another embodiment, there is a system for sealing a stage in a well. The system includes a frac plug located inside the well and having a through port, a ball seated at an upstream end of the through port and sealing the frac plug, a first actuation mechanism located in a body of the ball and configured to break the body into parts, and a downhole tool that actuates the first actuation mechanism when the downhole tool is positioned adjacent to the ball.

According to yet another embodiment, there is a method for actuating a ball and/or plug located in a well. The method includes lowering within the well, a downhole tool having a tool sensor, until adjacent to the ball or the plug, actuating the tool sensor of the downhole tool, sending a signal from the tool sensor to a corresponding sensor that is located on the ball or on the plug, in response to the signal, actuating an actuation mechanism of the ball or the plug, and breaking the ball or the plug into parts.

According to another embodiment, there is a ball for sealing a plug in a well. The ball includes a body, an actuation mechanism located inside the body and configured to break the body into parts, and a sensor connected to the actuation mechanism and configured to detect a presence of a base outside the body. The base is attached to another plug upstream the plug.

BRIEF DESCRIPTION OF THE DRAWINGS

The accompanying drawings, which are incorporated in and constitute a part of the specification, illustrate one or more embodiments and, together with the description, explain these embodiments. In the drawings.

DETAILED DESCRIPTION

The following description of the embodiments refers to the accompanying drawings. The same reference numbers in different drawings identify the same or similar elements. The following detailed description does not limit the invention. Instead, the scope of the invention is defined by the appended claims. The following embodiments are discussed, for simplicity, with regard to a ball that seals a plug in a horizontal portion of a well. However, the embodiments discussed herein are applicable to any well, vertical, horizontal, or slanted and also to any other actuated plug element, not only a ball.

Reference throughout the specification to "one embodiment" or "an embodiment" means that a particular feature, structure or characteristic described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular features, structures or characteristics may be combined in any suitable manner in one or more embodiments.

Figure 5:
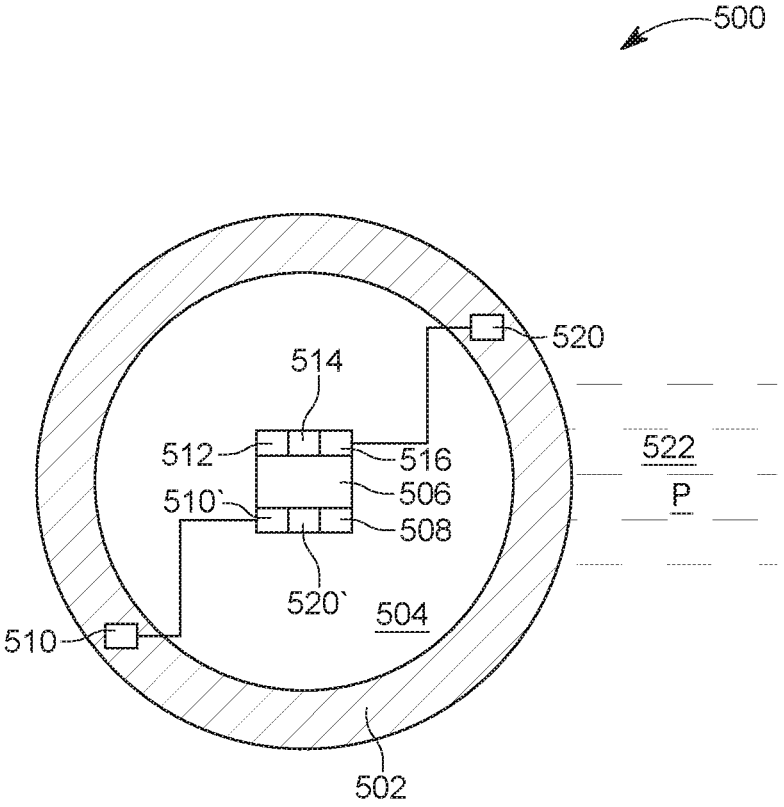
FIG. 5 illustrates a ball having an actuation mechanism and two or more sensors for triggering the actuation mechanism.

According to an embodiment illustrated in FIG. 5, an actuated plug element 500 (represented as a ball herein for simplicity) has a body 502 that may be made partially or totally from a degradable material. In one embodiment, no degradable material is part of the body 502. A chamber 504 is formed within the body 502 in which an actuation mechanism 506 is placed. The actuation mechanism may include, for example, an energetic material 508 (e.g., an explosive) which can be activated by a certain sensor 510 (e.g., a pressure sensor). Although in the following embodiments the actuation mechanism is shown located in a chamber, it is possible that no chamber is formed within the ball. For example, it is possible that the actuation mechanism and all other components of the ball are formed within the body of the ball.

In this regard, U.S. Patent Application Publication nos. 2015/0184486 and 2016/0130906 disclose that sensor 510 may be a pressure sensor that is set up to generate an activation signal to the actuation mechanism 506, to actuate the energetic material 508, when the ball reaches its desired position in the well. The desired position in the well is associated with a corresponding hydrostatic pressure $P_H$ in the well, which depends with the depth "h" of the ball in well, the density ρ of the fluid in the well, the gravity constant "g," and the atmospheric pressure $P_{atm}$, i.e., the hydrostatic pressure is given by $P_h=\rho gh+P_{atm}$.

Actuation mechanism 506 may also include a timing mechanism 512 that is triggered when the pressure sensor 510 measures a predetermined hydrostatic pressure. This means that after the ball 500 arrives at its intended destination in the well (i.e., at the corresponding plug), the pressure sensor 510 measures the predetermined hydrostatic pressure and sends a signal to the actuation mechanism 506. Timing mechanism 512 is actuated and starts counting a given time period (e.g., 8 h). At the end of the given time period, the actuation mechanism 506 actuates the energetic material 508 and the ball is broken into parts. This mechanism and associated time period is a fail-safe mechanism designed to eventually actuate the ball.

However, this mechanism offers no flexibility to the operator of the system, i.e., no capability to select the actuation of the ball based on the needs of the various phases of the fracturing operation. In other words, if the current stage fails to fracture or needs to be terminated as soon as possible, the operator has to wait for the timer to count down the 8 h time period until the ball is broken into parts. Thus, although the fracturing operation has been finalized early, for example, 6 h before the time that the ball is supposed to be actuated, the operator has not control of the actuation mechanism of the ball and cannot break the ball into parts earlier. This is valuable time that is wasted because the breaking of the ball into parts cannot be achieved earlier.

To resolve this defect of the existing balls, FIG. 5 shows the presence of a second sensor 520 in the body 502. While FIG. 5 shows the first and second sensors 510 and 520 embedded in a wall of the body 502, one skilled in the art would understand that the two sensors may be located on the outside of the body or even inside the chamber 504 as long as a pressure P of the ambient 522 can be measured by the sensors (e.g., if the sensors are located inside the chamber, there is a channel through the wall of the body that allows the external pressure to manifest inside the chamber). In this embodiment, for simplicity, it is assumed that first and second sensors 510 and 520 are pressure sensors located in the wall of the body. Those skilled in the art would understand that sensors 510 and 520 may be other type of sensors, as long as these sensors can determine a change in the well, e.g., two acoustic sensors that determine an acoustic signal sent by the operator.

Having two distinct sensors 510 and 520, it is possible to have the first sensor 510 set up to react to the hydrostatic pressure $P_h$ (e.g., about 1,000 to 3,000 psi, depending on the depth location of the ball) and the second sensor to a higher pressure, called trigger pressure herein, $P_{trigger}$. Although the following embodiments are discussed with regard to pressure sensors and various pressures triggering various timers in the ball, one skilled in the art would understand that other "triggers" may be used, as for example, an acoustic signal, an optical signal, a change in the density of the slur, a pH of the slur, etc. For these reasons, when another sensor than a pressure sensor is used, the various pressures noted herein should be replaced by a measured value of a parameter, where the parameter may be an electromagnetic field, acoustic wave, optical field, etc. In this embodiment, a first measured value of the parameter may be the hydrostatic pressure and a second measured value of the parameter may be the trigger pressure, as the parameter is the pressure. The trigger pressure $P_{trigger}$ needs to be selected to not interfere with the fracturing pressure $P_f$ that is applied during the fracturing stage, so that the destruction of the ball is not initiated by the fracturing operations. As an example, consider that the fracturing pressure is 10,000 psi and the hydrostatic pressure is about 3,000 psi. For this specific example, the trigger pressure $P_{trigger}$ can be selected to be 12,000 psi so that is does not interfere with the fracturing pressure. The above noted pressures are exemplary and not intended to limit the application of the invention. Other values may be used. In general, the trigger pressure is selected to be higher the fracturing pressure. Note that the hydrostatic pressure is always smaller than the fracturing pressure.

Figure 6:
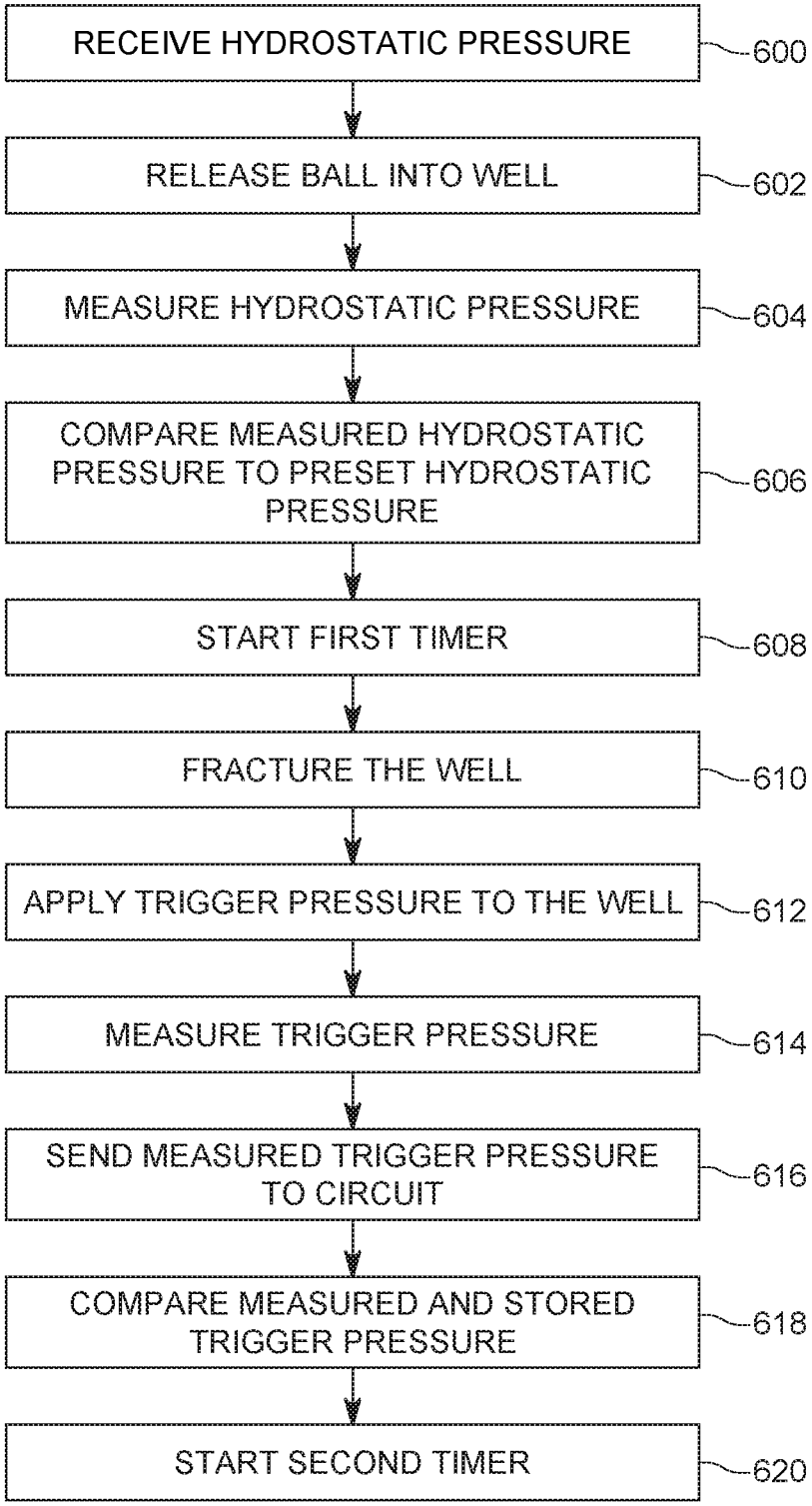
FIG. 6 is a flowchart of a method for actuating a ball having an actuation mechanism and two sensors.

Having the benefit of receiving information from the sensors 510 and 520, a processor or circuitry 514 of the actuation mechanism 506 is configured to actuate two different timers, one by the hydrostatic pressure and the other one by the trigger pressure. A method for actuating such a ball is discussed with regard to FIG. 6. Before being deployed into the well, the processor or circuitry 514 receives in step 600 a set hydrostatic pressure $P_h$ and the trigger pressure $P_{trigger}$ and stores them in a memory 516. Then, in step 602, the ball is released into the well and pumped to arrive at its intended destination, to seal a corresponding plug. In step 604, the first sensor 510 measures the ambient hydrostatic pressure $P_h$ and sends this information to processor or circuitry 514. Processor or circuitry 514 compares in step 606 the measured hydrostatic pressure with the stored hydrostatic pressure. If the measured pressure is equal or larger than the stored hydrostatic pressure, the processor or circuitry 514 starts in step 608 a first timer 510', associated with the fail safe of the ball. This timer has a set first time period, e.g., 8 h.

The fracturing operation is performed in step 610, with the fracturing pressure reaching various values. If during the fracturing operations there is any need to break the ball earlier than the 8 h time period triggered by the first pressure sensor 510, the operator of the well may instruct in step 612 the frac pump at the surface to increase the well pressure to the trigger pressure $P_{trigger}$, so that the second pressure sensor 520 measures this pressure in step 614. In step 616 the second pressure sensor 520 sends the measured trigger pressure $P_{trigger}$ to the processor or circuitry 514. The processor or circuitry 514 compares in step 618 the measured trigger pressure with the stored trigger pressure. If the measured trigger pressure is equal to or larger than the stored trigger pressure, processor or circuitry 514 actuates in step 620 a second timer 520'. The second timer is pre-programed before the ball is released into the well to count a second time period. Once the second period has elapsed, the energetic material 508 is activated to break the ball into pieces.

The second time period is different from the first time period, usually smaller than the first time period. For example, the second time period may have any value from a second to 2 h. It is noted that the second time period makes the ball to be broken into parts earlier than the first time period and the purpose of the second time period is to offer the operator an opportunity to break the ball, when a certain event occurs during the fracturing stage, but before the first time period expires. Thus, in one application, the first time period is in the range of hours while the second time period is in the range of minutes. In still another application, the first time period is in the range of hours while the second time period is in the range of seconds.

The functionality discussed above may be implemented with no processor and memory, i.e., only with circuitry that associates the first sensor 510 with the first timer 510' and the second sensor 520 with the second timer 520'. In an alternative embodiment, more than two sensors may be used, for example, if first and second different trigger pressures are desired to be implemented. For example, the first trigger pressure may be linked to an ambient pressure of 12,000 psi and starts a timer having a time period of about 2 h and the second trigger pressure may be linked to an ambient pressure of 14,000 psi and starts another timer having a time period of about 1 min. These numbers are exemplary and those skilled in the art would understand that any other values for the time periods and pressures may be used. In one application, the trigger pressure is higher than the fracturing pressure. In the same application, the hydrostatic pressure for any depth of the well is smaller than the fracturing pressure. In the same application or another one, the first time period is larger than the second time period. In the same application or another application, the second time period is substantially zero, i.e., an instant destruction of the ball can be achieved. For this case, the ball is coated with a non-degradable layer or the exposed surface of the ball is made/processed to not degrade.

Figure 7:
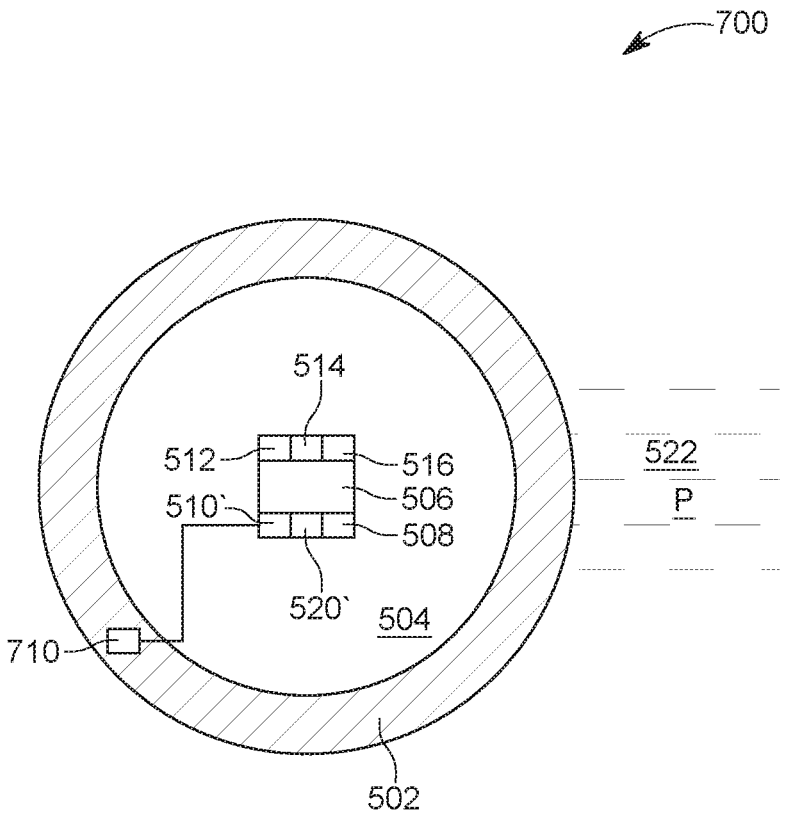
FIG. 7 illustrates a ball having an actuation mechanism and a sensor for triggering the actuation mechanism.

While the ball shown in FIG. 5 has a first sensor 510 for determining a hydrostatic pressure (the fail-safe pressure) and a second pressure 520 for determining a trigger pressure, the ball 700 shown in FIG. 7 has a single pressure sensor 710, which is used to measure both the hydrostatic pressure and the trigger pressure. In this case, the sensor sends its measurements to the processor or circuitry 514 and when the hydrostatic pressure is determined, the first timer is started, and when the trigger pressure is determined, the second timer is started. In this embodiment, the processor or circuitry may be configured to handle multiple trigger pressures, each associated with a different time period. Note that a timer is known in the art and may be implemented either as dedicated circuitry or as a software in processor 514. If the circuitry or processor 514 is present, other actuation methods may be used, for example, the ball may be actuated by a predefined series of high pressure periods followed by a series of low pressure periods. In still another embodiment, a code can be designed, for example, similar to the Morse code, where a high pressure corresponds to a dash in the Morse code and a low pressure corresponds to a dot in the same code. In this way, more complex commands may be transmitted to the circuitry or processor 514. For example, with such a code in place, the preset time period of any timer may be changed during the fracturing process by simply communicating from the surface, through this code, the new time period. Those skilled in the art would also understand that the low and high pressures may be used as ones and zero, to establish a digital communication with the circuitry or processor 514.

Returning to the ball 500 of FIG. 5, in one embodiment, the processor or circuitry 514 may be configured to receive measurements from both sensors 510 and 520, and calculate a differential pressure between the two readings. In this embodiment, the differential pressure is the trigger pressure. If the differential pressure is larger than a certain threshold, then the circuitry activates the second timer. The first sensor 510's readings may still be used to trigger the first timer.

Figure 8:
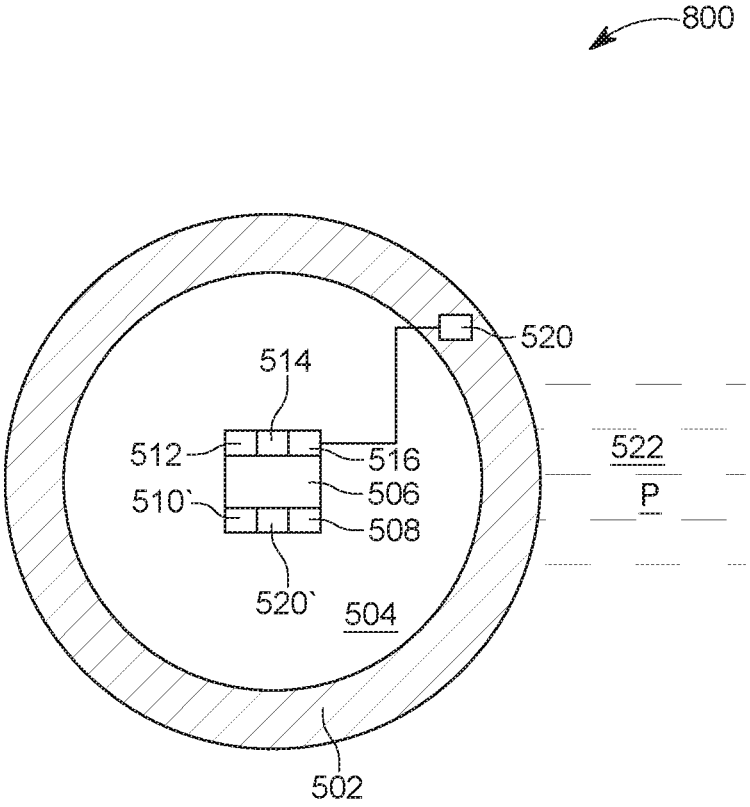
FIG. 8 illustrates a ball having an actuation mechanism and a sensor for triggering the actuation mechanism.

In another embodiment illustrated in FIG. 8, the ball 800 has no fail safe mechanism as sensor 510 is missing. This means, that no hydrostatic pressure is used to start a first timer. For this embodiment, the second sensor 520 is used to measure one or more trigger pressures, which are set up to be higher than the fracturing pressure. Each trigger pressure is associated with a corresponding timer 510' and 520', and each timer may have a different time period value. Thus, the operator has the freedom to break the ball into pieces and to retake control of the stage behind the ball at various times associated with the timers, which can be from one second to many hours.

This and the previous embodiments use multiple pressure settings for starting plural timers, depending on the need of the operator. Such a ball configuration is flexible, which is not the case for the traditional balls, which can be broken at a single given time, which is dictated by the single timer that is present on the ball and started at the hydrostatic pressure. Note that the above embodiments discuss a timer that delay breaking the ball after a certain pressure is measured. However, it is possible that the above embodiments are implemented with no timer for the second sensor 520, which means that the ball is broken as soon as the operator applies the trigger pressure and the sensor measures such pressure. While this embodiment has been discussed assuming that the timer is an electronic mechanism, it is possible to apply the teachings of the embodiments of this document to any timer, even timers without electronics. For example, it is possible to actuate the ball by simply applying the trigger pressure, which when measured by the pressure sensor, automatically actuates the energetic material 508. This embodiment and any of the embodiments discussed herein may make use of materials for the ball that are degradable or not.

Figure 9A:
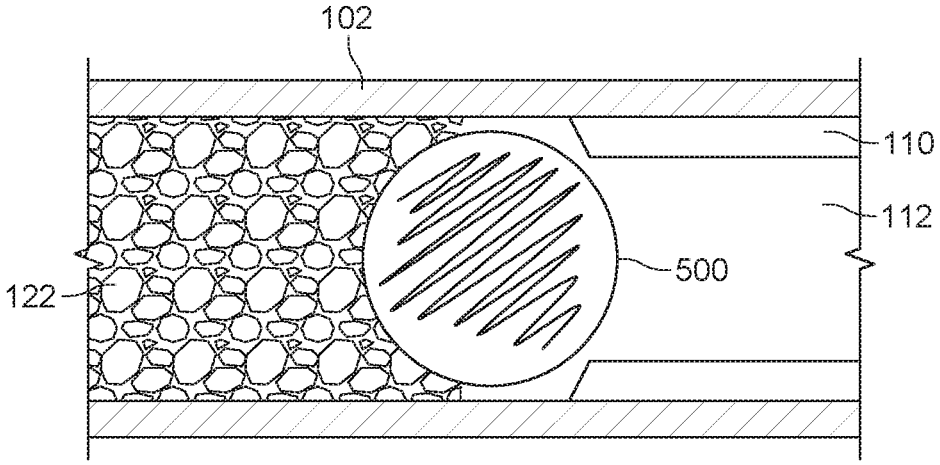
FIGS. 9A to 9C illustrate how a ball having an actuation mechanism is broken inside a well.
Figure 9B:
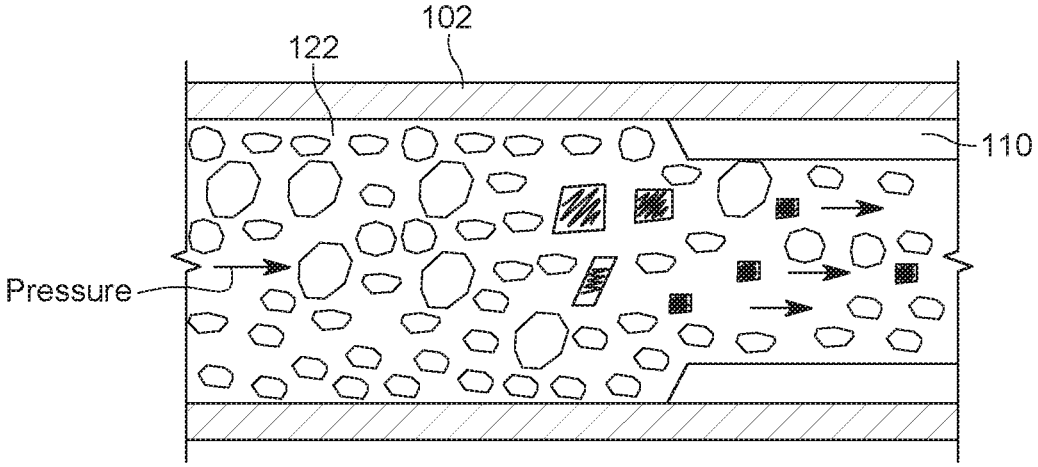
Figure 9C:
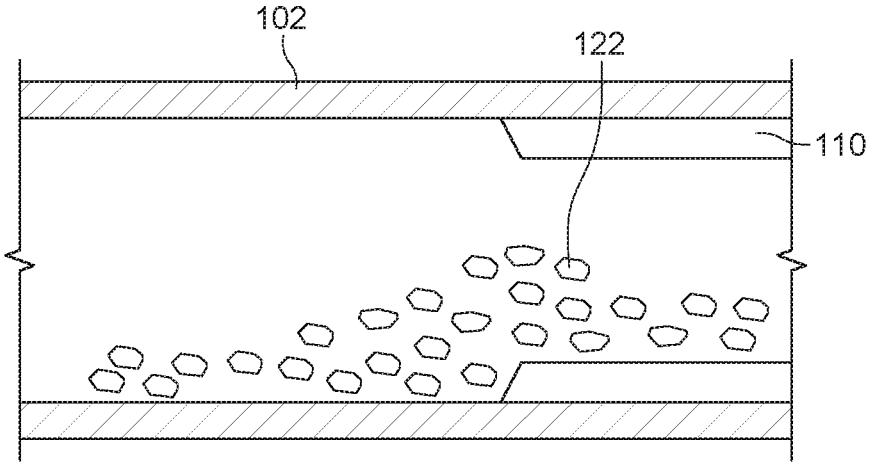

According to any of the embodiments discussed above, the ball 500 would not actuate a timer associated with the second sensor 520 until the trigger pressure is reached. FIG. 9A shows the ball 500 being seated at a plug 110 and sand 122 being accumulated upstream the ball. The time delay for timer 520' would then be selected such that the ball 500 would fragment, as shown in FIG. 9B, while the frac pumps are still active, so that the pressure drop at the well head would indicate the ball detonation. In this case, the operator of the well would be able to record that (a) the ball 500 actuated, and (b) that the sand pack 122 was disturbed sufficiently such that the ball would degrade in excess water, preventing the creation of a precipitate cemented sand plug, as illustrated in FIG. 9C. Note that in this case, because the operator was able to control the timing of the ball actuation, and made that time to coincide with the time when the frac pumps are active, enough pressure was applied to the fluid in the well with the frac pumps to force the sand 112 and the debris from the ball to move through the plug 110. This coordination between (1) actuating the ball within a selectable time and (2) being able to also control the frac pump to be active at the same time, prevents the problems discussed in the background section and associated with the traditional balls.

Figure 10:
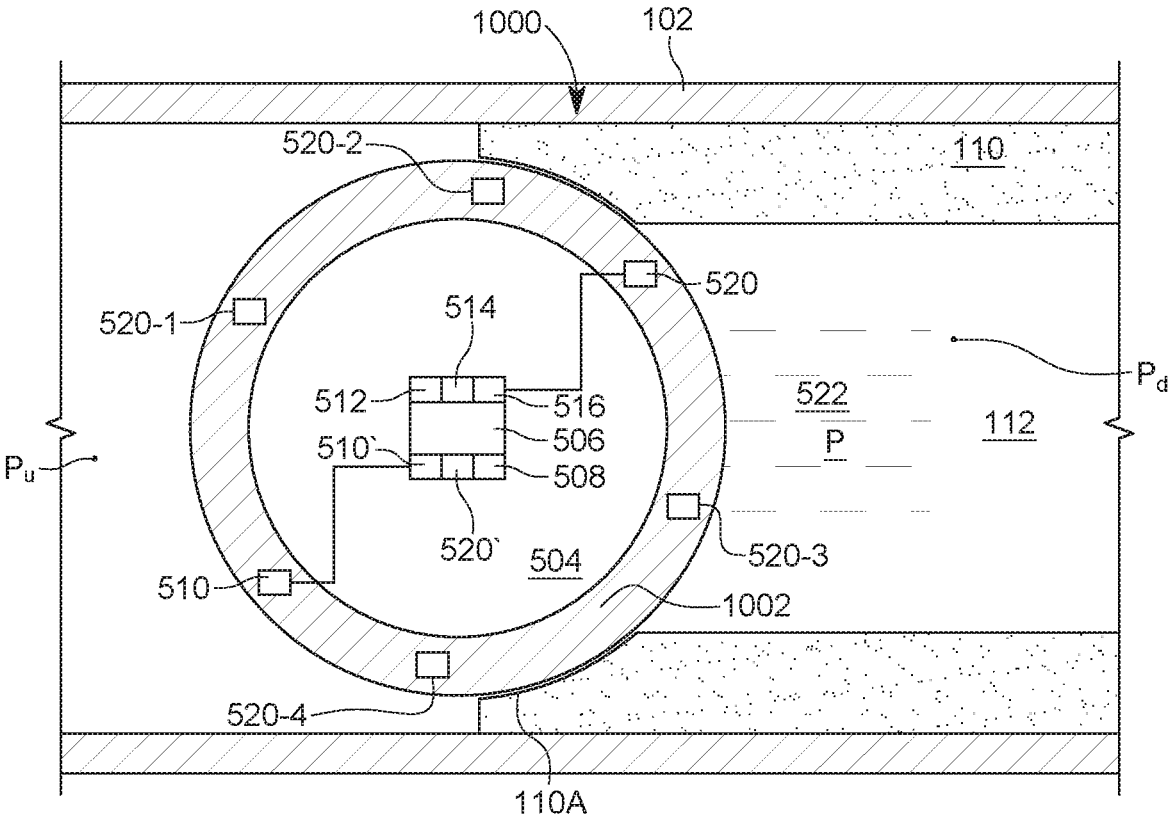
FIG. 10 illustrates a ball having an actuation mechanism and plural sensors for initiating the actuation mechanism.

According to another embodiment illustrated in FIG. 10, in addition to the first and second sensors 510 and 520 shown in FIG. 5, other similar sensors 520-1 to 520-4 are added. These sensors are distributed throughout the body 1002 of the ball 1000 so that whatever the position of the ball in the seat of the plug, at least two sensors are not inside the plug. In other words, as the ball 1000 takes its position in the seat 110A of the plug 110, one or more sensors 510, 520, and 520-1 to 520-4 would be located to face the through port 112 (sensors 520 and 520-3 in this embodiment) while one or more sensors (510, 520-1 and 520-4 in this embodiment) face the upstream portion of the casing 102.

According to this embodiment, the plural sensors are distributed throughout the body of the ball to ensure that the pressure Pu in the upstream casing is detected. Note that the pressure Pd in the downstream casing is not the same as the pressure Pu that the frac pumps are applying to the well and thus, in order that the ball detects the trigger pressure (which is the upstream pressure Pu), at least one sensor needs to face the upstream portion of the casing. The same is true if the trigger pressure is a differential pressure, i.e., at least one sensor needs to face the upstream part of the casing for measuring the upstream pressure Pu and at least one sensor needs to face the through port 112 to measure the downstream pressure Pd. Those skilled in the art would know what is the minimum number of sensors that a ball would need to satisfy these conditions.

Figure 1:
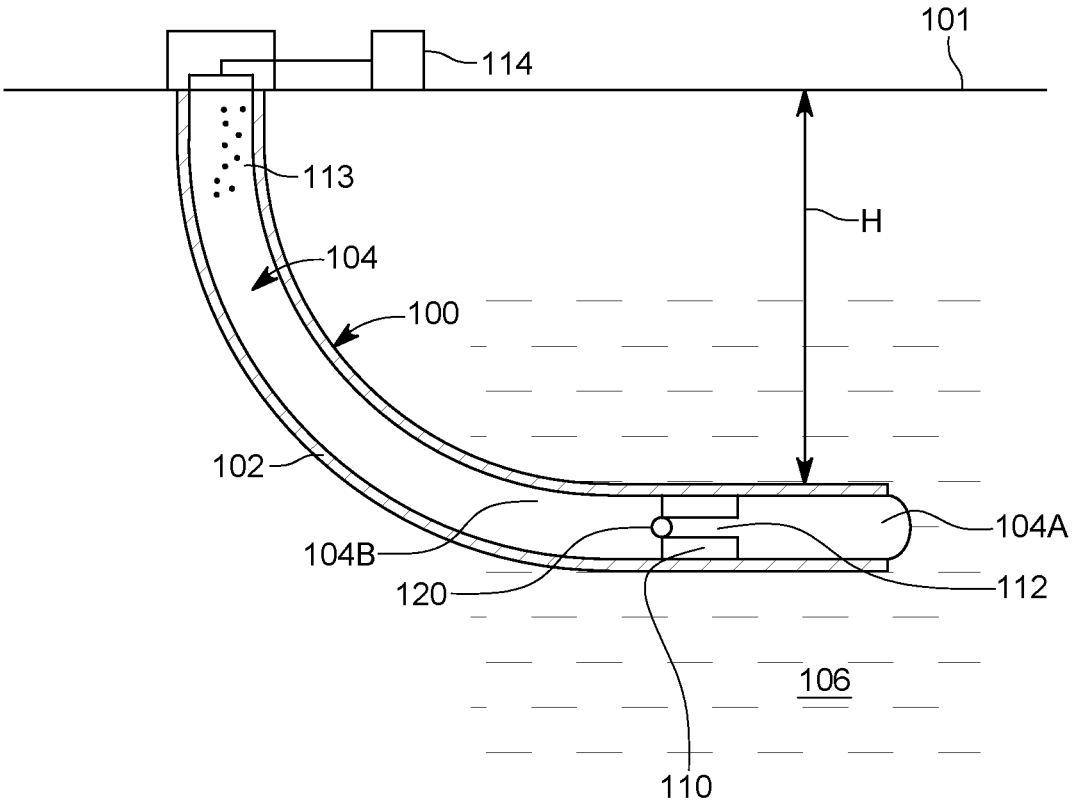
FIG. 1 illustrates a well and associated equipment for well completion operations.
Figure 2:
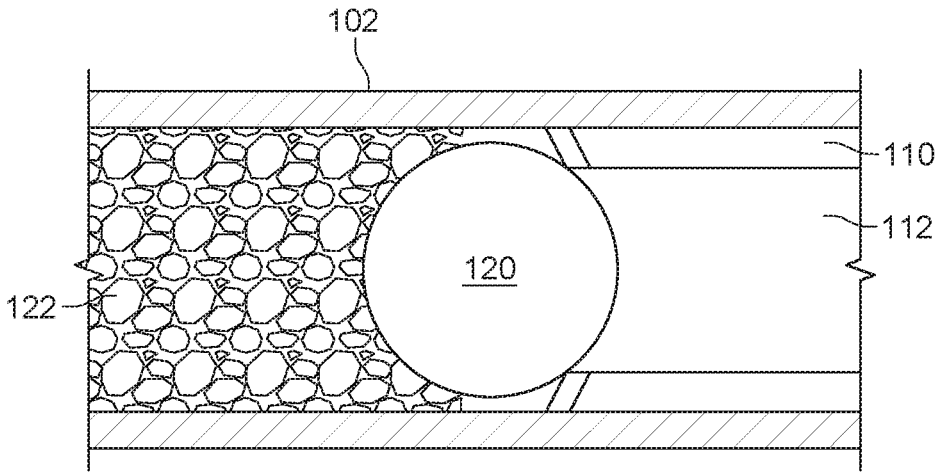
FIGS. 2 and 3 illustrate a plug placed in a well and sealed with a degradable ball.
Figure 3:
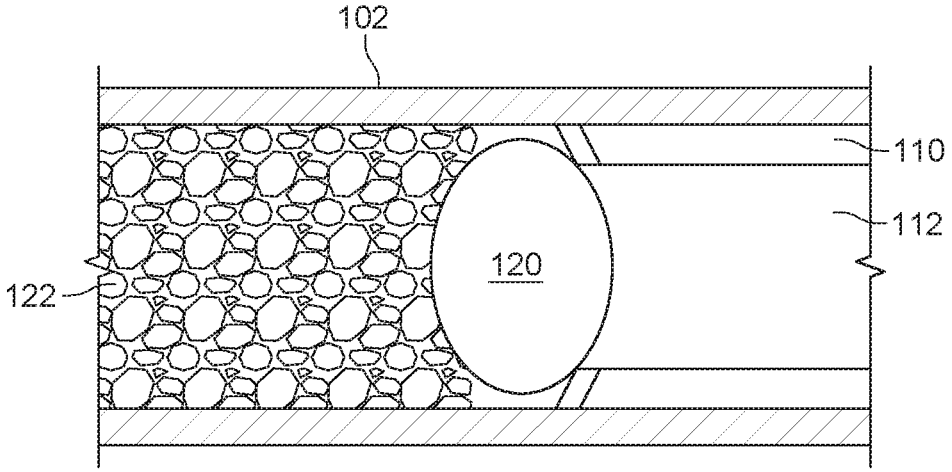
Figure 4:
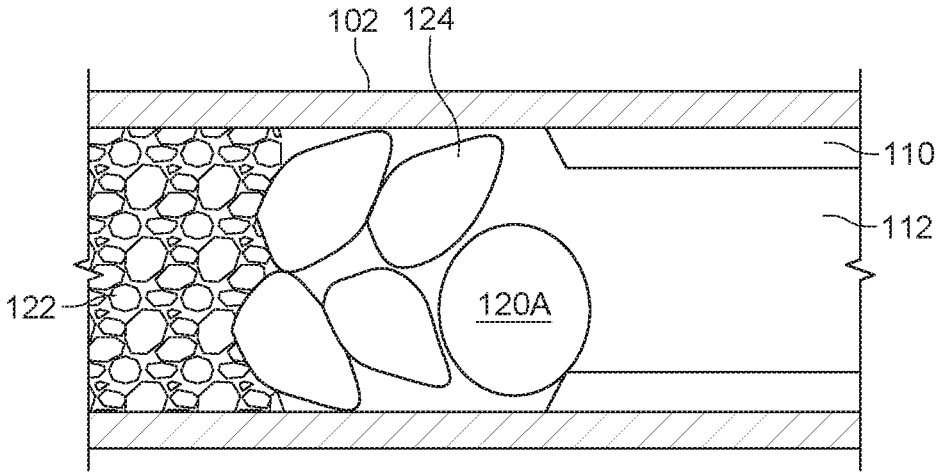
FIG. 4 illustrates how a degradable ball breaks into parts and still blocks the plug.
Figure 11:
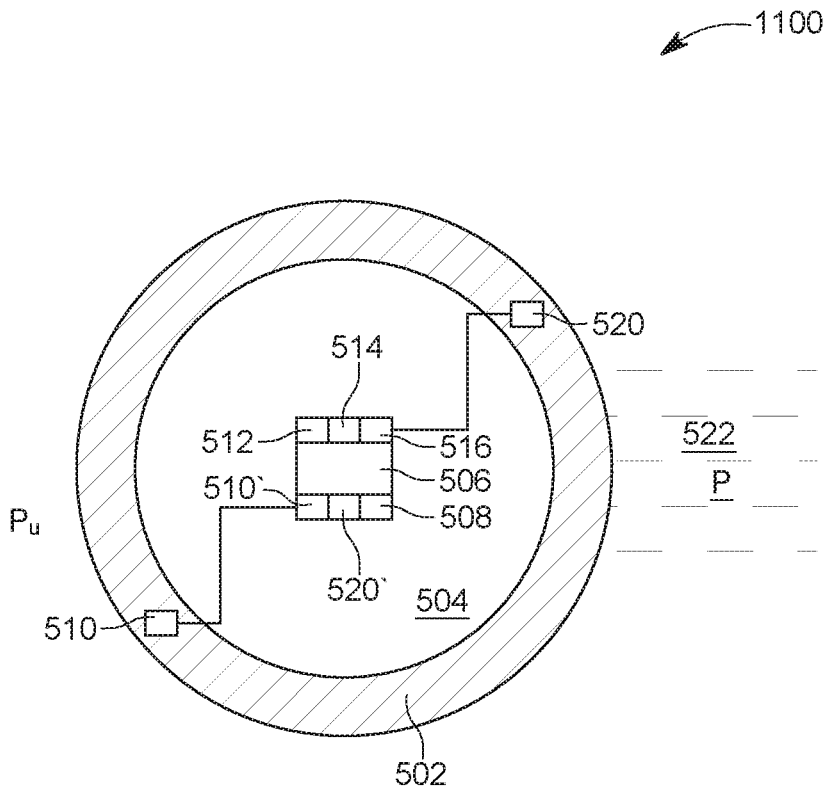
FIG. 11 illustrates a ball having an actuation mechanism and two sensors for triggering the actuation mechanism.

According to still another embodiment illustrated in FIG. 11, a ball 1100, similar to the ball of the embodiment illustrated in FIG. 5, may be configured to actuate when a measured pressure Pu in the upstream part of the casing is below a formation pressure. This is the case that corresponds to a flowback of the well. The pressure in the formation 106 in FIG. 1, which is connected to a current stage of the well, is called herein the formation pressure $P_{form}$. The formation pressure is below the fracturing pressure and above the hydrostatic pressure. Because the formation pressure is below the fracturing pressure, the processor or circuitry 514 of the ball 1100 is configured to not activate the ball when the sensor measures the first time a pressure that is equal to or above the formation pressure $P_{form}$. After the sensor has measured once the formation pressure $P_{form}$, if a second measurement of the same formation pressure $P_{form}$ is determined, the processor or circuitry 514 would activate the energetic material 508.

Figure 12:
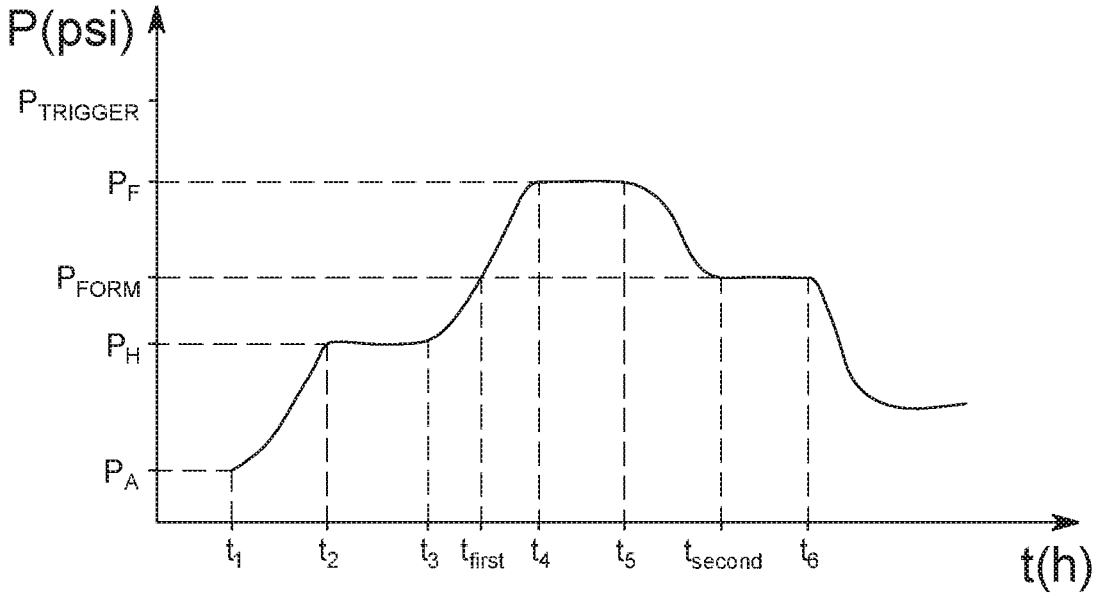
FIG. 12 illustrates the various pressures exerted on the ball during a fracturing operation.

In this regard, FIG. 12 illustrates the pressure that is acting on the ball 1100 after the ball has been released in the well. The initial pressure measured by the sensors, just before the ball is released into the well, is the atmospheric pressure $P_a$ (e.g., 14.7 psi). This pressure is measured at an initial time t1. As the ball is pumped towards its corresponding plug, the pressure increases until the ball reaches its final destination at t2, when the pressure becomes the hydrostatic pressure $P_H$. Supposing that the stage above the ball has been connected to the formation (i.e., the casing of the well has been perforated), the fracturing operation is started at time t3. During the fracturing operation, the pressure in the stage above the ball is increased to the fracturing pressure $P_f$. Note that the formation pressure $P_{form}$ is larger than the hydrostatic pressure and smaller than the fracturing pressure. The formation pressure depends on the applied fracturing pressure and the characteristics of the formation connected to the stage. The fracturing operation stops at time t4.

Based on the observation that the current stage's pressure after time t4 will decrease, either because one or more frac pumps may fail or because the formation may absorb some more fluid from the well, it is possible in one embodiment to program the actuation mechanism in the ball based on an anticipated pressure profile. Thus, in this application, it is possible to actuate the ball when two conditions are satisfied: (1) the fracturing pressure has been achieved, and (2) after a certain pressure tolerance window, the current pressure is falling. For example, suppose that the fracturing pressure is expected to be 10,000 psi. The operator of the ball can program the actuating mechanism to determine when the fracturing pressure has been achieved, within a certain pressure range (e.g., between 9,500 and 10,000 psi), determine that the pressure is falling (e.g., current pressure is measured to be 9,000 psi), and if the difference between the lowest value of the fracturing pressure range and the current pressure is larger than the pressure tolerance window (e.g., 300 psi), then actuate the actuation mechanism. Because in this particular example, the difference between the current pressure 9,000 psi and the fracturing pressure 9,500 psi is larger than the pressure tolerance window (300 psi), the actuation mechanism is triggered. The configuration in this embodiment can be considered as a safety feature, where the ball is always actuated when the pump loses pressure or is ramped down, or when the stage otherwise loses injectivity.

FIG. 12 also shows one trigger pressure $P_{trigger}$ that can be used in the previous embodiments to actuate the ball. Note that the trigger pressure for the previous embodiments is higher than the fracturing pressure. However, for the present embodiment, the formation pressure that would actuate the ball is smaller than the fracturing pressure but higher than the hydrostatic pressure. Because the pressure increases during the fracturing operation from the hydrostatic pressure to the fracturing pressure, the sensor 520 in the ball 1100 would measure at time $t_{first}$ the formation pressure $P_{form}$. However, this is not the correct time for actuating the ball. Thus, the processor or circuitry 514 is configured to not actuate the ball when first measuring the formation pressure $P_{form}$. In one embodiment, the formation pressure is set up before the ball is released into the well, for example, at 5,000 psi. Other values may be used.

After the perforation operation is completed at time t5, the pressure in the stage is decreasing until reaching the formation pressure again, at time $t_{second}$. Later, when the well needs to be put into exploration, the ball needs to be removed. Thus, the well enters into a flowback stage, when the frac pumps remove the fluid inside the well to lower its pressure. At this time t6, the pressure inside the well decreases. When the processor or circuitry 514 determines the second time the formation pressure $P_{form}$, e.g., at time $t_{second}$, the energetic material 508 is actuated or first a timer is started and then the energetic material is actuated. The time period of the timer may have any value (i.e., predetermined value). Those skilled in the art would understand that while this embodiment discussed an implementation that uses a processor or circuitry, it is also possible to use a mechanical element, e.g., a J-slot actuation requiring a high-low pressure cycle. Other implementations may be used as discussed above.

Having the trigger pressure to be the formation pressure in this embodiment, which is associated with the flowback stage of the well and not the fracturing stage, may be advantageous because the operator may be able to see each ball actuate and each stage coming back online. This could provide useful well diagnostic clues.

Figure 13:
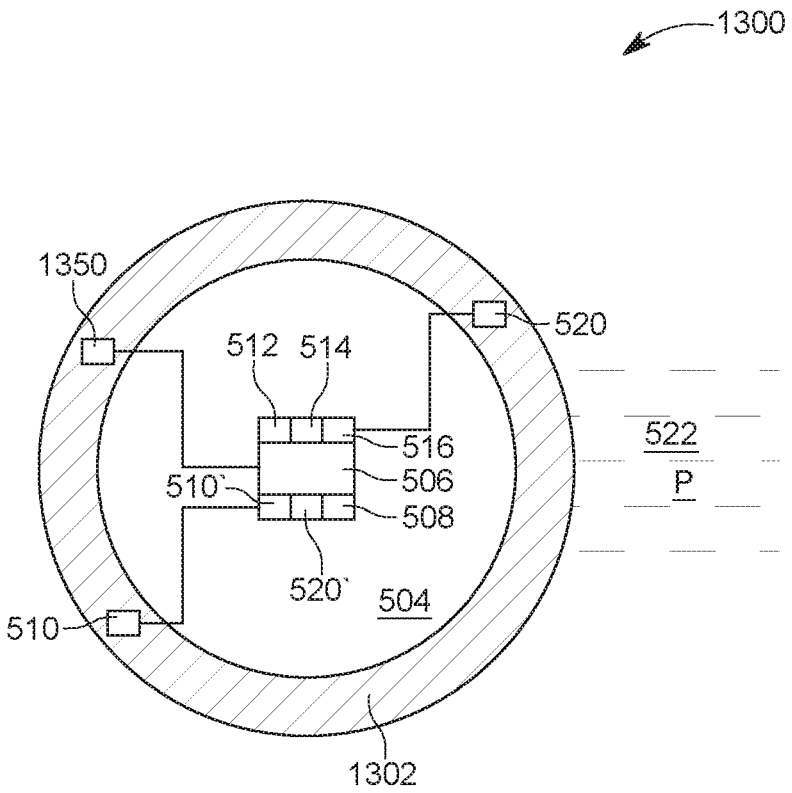
FIG. 13 illustrates a ball having an actuation mechanism and a sensor that actuates the ball when in a vicinity of a base.

In still another embodiment illustrated in FIG. 13, a ball 1300 may use, instead or in addition of the sensors 510 and 512 shown in the embodiment of FIG. 5, another type of sensor 1350, which is configured to communicate with the upstream plug. When this communication takes place, the processor or circuitry 514 arms the ball by actuating a timer. At the end of the time period counted by the timer, the actuation mechanism 506 actuates the energetic material 508 and the ball is broken into parts.

Figure 14A:
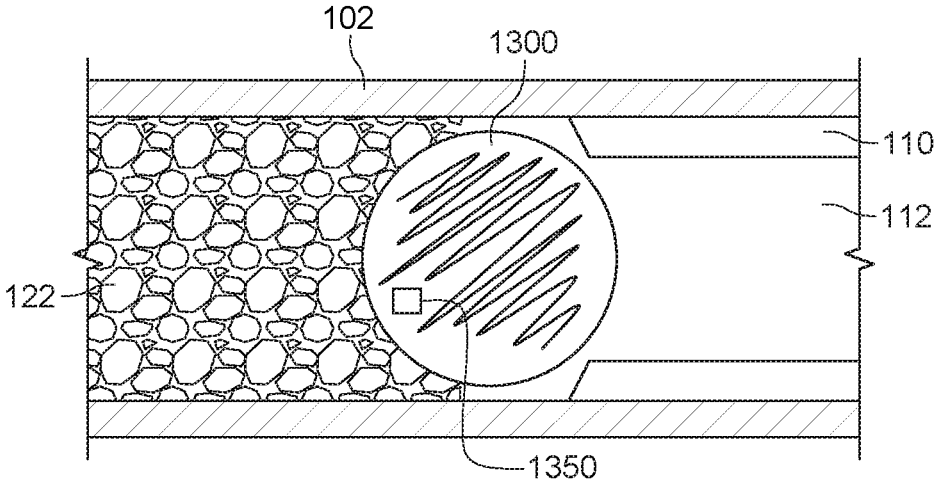
FIGS. 14A to 14D illustrate how a ball is broken into parts by an actuation mechanism that is actuated during a flow-back stage.
Figure 14B:
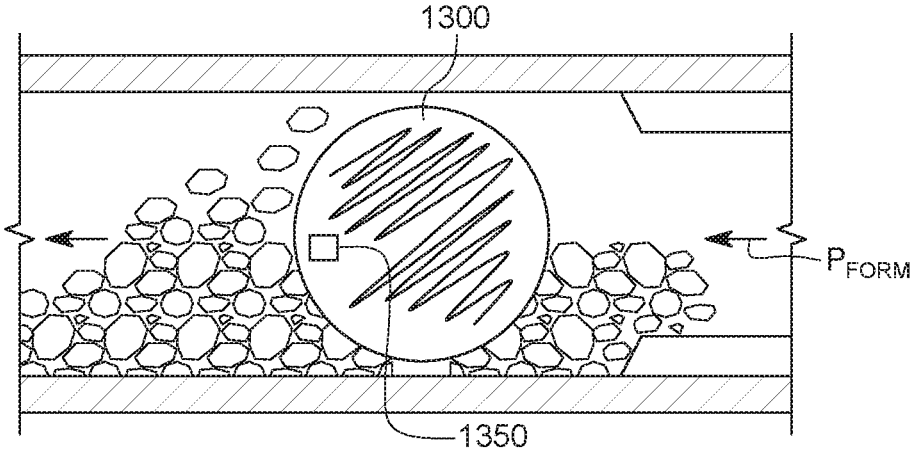
Figure 14C:
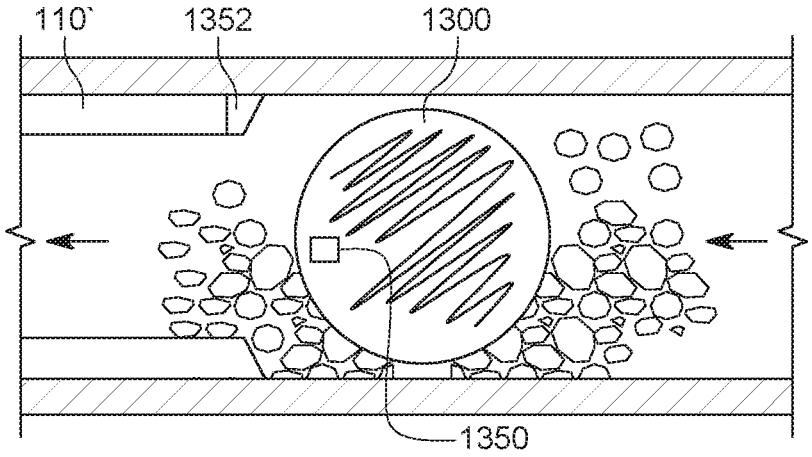
Figure 14D:
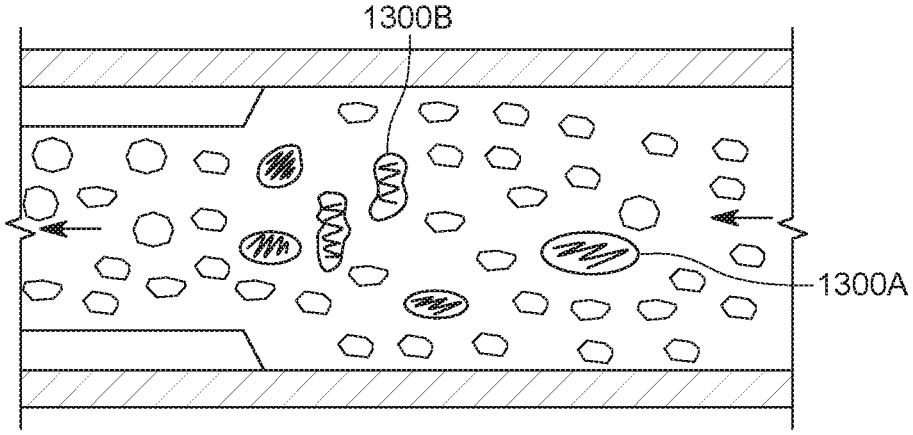

In this embodiment, sensor 1350 is a radio-frequency identification (RFID) chip that uses electromagnetic fields to communication with a base. The base may be mounted on the upstream plug, not the plug that is housing the ball. In this respect, FIG. 14A shows ball 1300 having sensor 1350 and sealing a corresponding plug 110. When the pressure upstream the ball is reduced, during the flowback stage, the ball 1300 starts to move, as shown in FIG. 14B, upstream toward an upstream plug, due to the fact that the formation pressure in the stage behind the ball becomes larger than the pressure upstream the ball. The ball 1300 approaches the upstream plug 110', which has the base 1352. When the base 1352 is in communication range with sensor 1350, sensor 1350 sends a signal to processor or circuitry 514, for starting a timer. The timer may be configured to count any time period. At the end of the time period, the actuation mechanism 506 actuates the energetic material 508 and the ball is broken into parts 1300A and 1300B, as illustrated in FIG. 14D. The RFID sensor 1350 may be replaced, for example, with another sensor that uses short range communication (e.g., low power Bluetooth sensor or acoustic sensor) for communicating with the base, or a key feature that matches a corresponding feature in the upstream plug.

Figure 15:
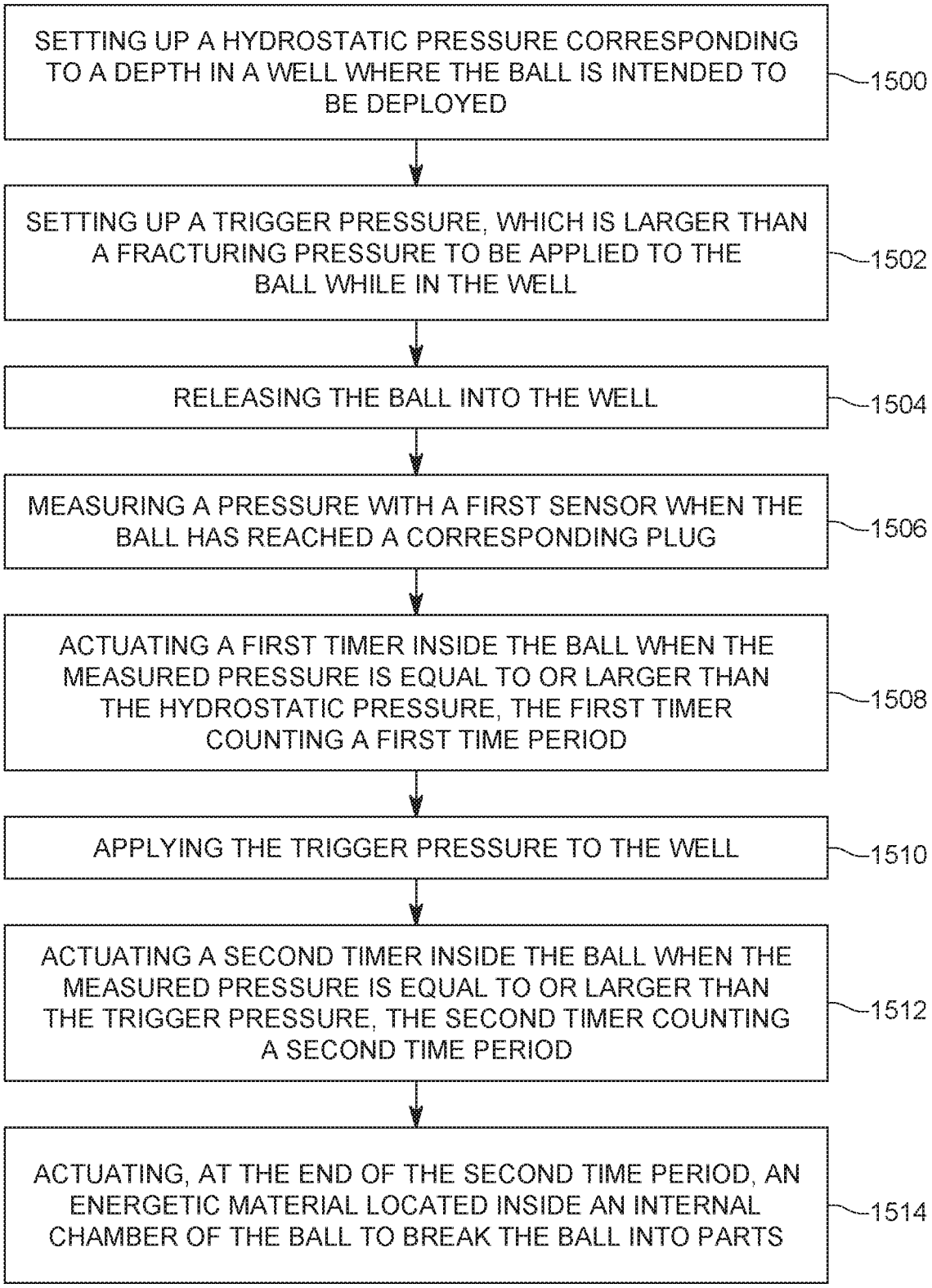
FIG. 15 is a flowchart of a method for breaking the ball while in a well.

According to an embodiment illustrated in FIG. 15, a method for breaking a ball inside a well includes a step 1500 of setting up a hydrostatic pressure corresponding to a depth in a well where the ball is intended to be deployed, a step 1502 of setting up a trigger pressure, which is larger than a fracturing pressure to be applied to the ball while in the well, a step 1504 of releasing the ball into the well, a step 1506 of measuring a pressure with a first sensor when the ball has reached a corresponding plug, a step 1508 of actuating a first timer inside the ball when the measured pressure is equal to or larger than the hydrostatic pressure, the first timer counting a first time period, a step 1510 of applying the trigger pressure to the well, a step 1512 of actuating a second timer inside the ball when the measured pressure is equal to or larger than the trigger pressure, the second timer counting a second time period, and a step 1514 of actuating, at the end of the second time period, an energetic material located inside an internal chamber of the ball to break the ball into parts, where the hydrostatic pressure is a pressure exerted by a fluid in the well at a location of the ball, and the trigger pressure is a pre-determined pressure, higher than the hydrostatic pressure.

Figure 16:
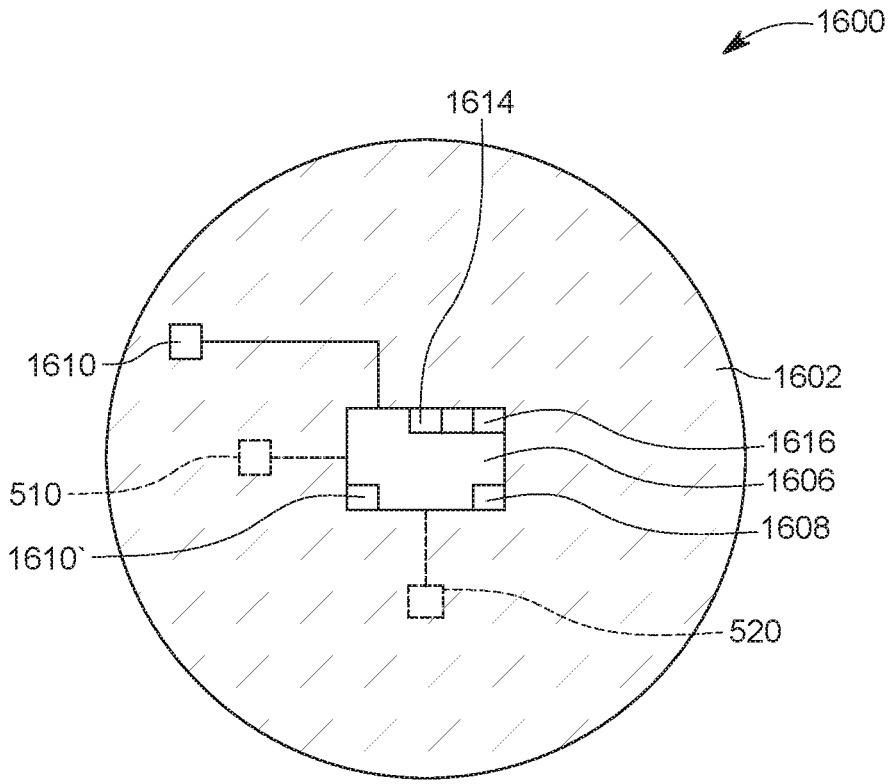
FIG. 16 illustrates a ball having an actuation mechanism and a sensor for triggering the actuation mechanism.

According to another embodiment illustrated in FIG. 16, a ball 1600 has an actuation mechanism 1606 formed inside the body 1602 of the ball and the actuation mechanism 1606 is connected to a sensor 1610. Sensor 1610 may be an RFID, electromagnetic sensor (i.e., a sensor that senses an electric field, a magnetic field or both), an acoustic sensor (i.e., a sensor that senses a change in pressure, like a hydrophone), an optical sensor (i.e., a sensor that senses a change in the frequency or wavelength of an electromagnetic wave) or any other sensor that is capable to sense a change in a property/parameter inside the well. For the sake of simplicity, in this embodiment, it is assumed that the sensor 1610 is an RFID sensor.

The actuation mechanism 1606 may have any of the configurations discussed above, i.e., have circuitry or processor 1614, memory 1616, one or more timers 1610' and energetic material 1608. However, one or more of these elements may also be removed as long as the actuation mechanism 1606 can break the ball into parts. In one embodiment, the ball may also include sensors 510 and/or 520 discussed above, that respond to the various pressures (or other signals) for actuating the actuation mechanism. Because sensors 510 and/or 520 are optional, they are illustrated with a dash line in FIG. 16. The body of the ball may be made of a degradable material as discussed above. In one embodiment, the body of the ball is not made of a degradable material. Still, in another embodiment, the body of the ball is made of a degradable material, but it is coated on the outside with a non-degradable material.

Figure 17:
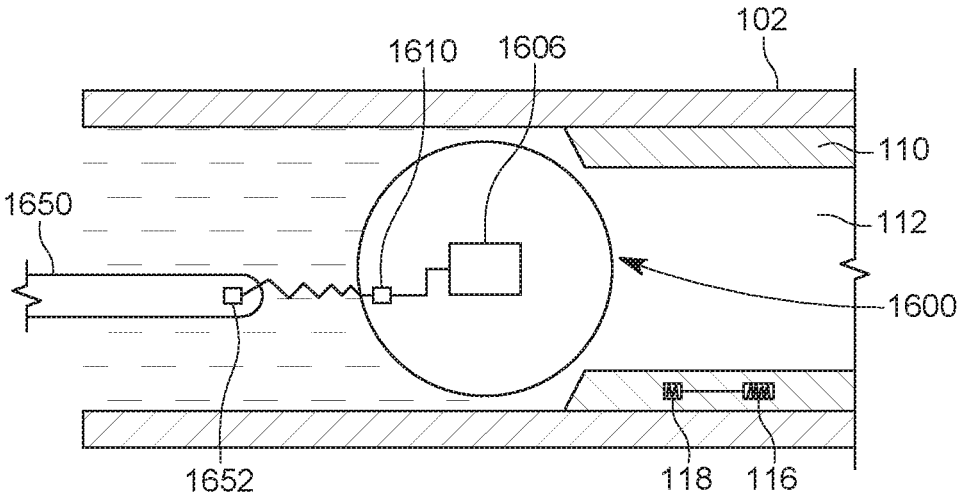
FIG. 17 illustrates a ball having an actuation mechanism and a sensor that communicates with a corresponding sensor located on a downhole tool.

FIG. 17 shows the ball 1600 siting in its seat in a frac plug 110. Frac plug is attached to the well 102 and has an internal through port 112. FIG. 17 also shows a downhole tool 1650 (for example, a coiled tubing) that is run from the surface to the ball. The tool 1650 includes a sensor 1652 that may be actuated from the surface, by the operator of the well. Sensor 1652 is selected to be capable to communication with the ball sensor 1610. For example, if the ball sensor 1610 is an RFID, then the coil sensor 1652 is a radio-transmitter, called herein interrogator. If the ball sensor 1610 is an optical sensor, then the coil sensor 1652 may be an optical fiber or a source of light. If the ball sensor is a pH sensor, then the coil sensor 1652 may be a container that releases a chemical that changes a pH inside the well, close to the ball. Those skilled in the art having the benefit of this disclosure would be able to come up with other sensors that achieve the same results as the sensors discussed above.

When there is a desire to remove the ball, the downhole tool 1650 is lowered into the well until the coil sensor 1652 is in the vicinity of the ball. At this time, the coil sensor 1652 is activated from the surface to send a pre-determined code (e.g., an RF signal or optical signal or acoustic signal) to the ball sensor 1610. Upon detection of the predetermined signal, the ball sensor 1610 sends this information to actuation mechanism 1606, which actuates the ball with a given time delay, as discussed in the previous embodiments. The actuation may be mechanical or implemented in circuitry, as discussed in the previous embodiments. If the actuation is implemented in circuitry, the timing of the actuation may be instantaneous or time delayed, as dictated by a corresponding timer.

In one embodiment, the coiled tubing 1650 may be run with a mill, to mill the frac plug 110 and/or the ball 1600. The ball may be made to be degradable or not. If the ball is not degradable, the coiled tubing may be able to circulate the debris from the ball, if the debris is small enough. Thus, the cleanout operation may be significantly faster and the ball is positively actuated, i.e., not relying on a pressure or another condition in the well to happen. If the coiled tubing is used without a mill, the coiled tubing may be sized to pass through a large bore frac plug 110.

In one embodiment, the plug 110 itself may have an actuation mechanism 116 and a frac sensor 118, similar or not to the actuation mechanism 1606 and the sensor 1652 of the balls discussed herein. If the actuation mechanism 116 is present, after the coiled tubing 1650 has actuated the ball 1600, the coil sensor 1652 may be moved closer to the plug 110 and instructed to communicate with the frac sensor 118 (which may be similar to ball sensor 1610) to actuate the frac plug. In this way, the coiled tubing may be used to actuate all the balls and frac plugs present in the well or only a part of them. For this situation, the cleanout process is further simplified and the time required for this process is shortened.

Figure 18:
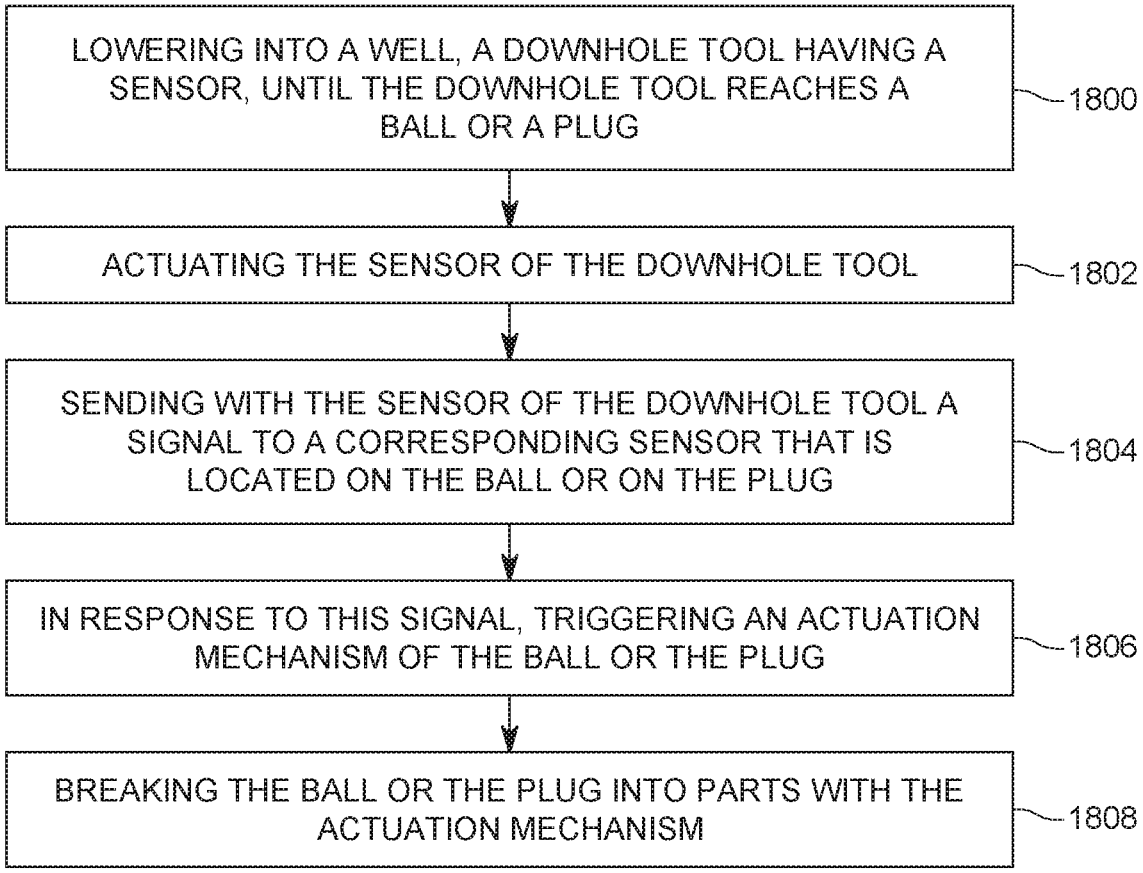
FIG. 18 is a flowchart of a method for triggering an actuation mechanism of a ball with a sensor located on a downhole tool.

A method for actuating a ball and/or plug with a sensor located on a downhole tool is now discussed with regard to FIG. 18. In step 1800, the downhole tool 1650 having a sensor 1652 is lowered into the well until it becomes adjacent to the ball or the plug. In step 1802, the sensor 1652 of the downhole tool 1650 is actuated by the operator of the well. In step 1804, the sensor 1652 sends a signal to a corresponding sensor that is located on the ball or on the plug. In response to this signal, an actuation mechanism of the ball or the plug is engaged in step 1806 and in step 1808, the ball or the plug is broken into parts.

The disclosed embodiments provide methods and systems for controlling more accurately a breaking time of a ball that mates with a plug in a well. It should be understood that this description is not intended to limit the invention. On the contrary, the exemplary embodiments are intended to cover alternatives, modifications and equivalents, which are included in the spirit and scope of the invention as defined by the appended claims. Further, in the detailed description of the exemplary embodiments, numerous specific details are set forth in order to provide a comprehensive understanding of the claimed invention. However, one skilled in the art would understand that various embodiments may be practiced without such specific details.

Although the features and elements of the present exemplary embodiments are described in the embodiments in particular combinations, each feature or element can be used alone without the other features and elements of the embodiments or in various combinations with or without other features and elements disclosed herein.

This written description uses examples of the subject matter disclosed to enable any person skilled in the art to practice the same, including making and using any devices or systems and performing any incorporated methods. The patentable scope of the subject matter is defined by the claims, and may include other examples that occur to those skilled in the art. Such other examples are intended to be within the scope of the claims.

What is claimed is:

1. A ball for sealing a plug in a well, the ball comprising:
a body;
an actuation mechanism located in the body and configured to break the body into parts; and
a ball sensor located on the body and configured to activate the actuation mechanism,
wherein the ball sensor is configured to receive a predetermined code from a tool sensor, which is located on a downhole tool, next to the body, and
wherein the downhole tool extends from a surface of the well.

2. The ball of claim 1, wherein the ball sensor is a pressure sensor.

3. The ball of claim 1, wherein the ball sensor is a radio-frequency receiver.

4. The ball of claim 1, wherein the ball sensor is an optical sensor.

5. The ball of claim 1, wherein the ball sensor is an acoustic sensor.

6. The ball of claim 1, wherein the ball sensor is a pH sensor.

7. The ball of claim 1, wherein the downhole tool is a coiled tubing.

8. The ball of claim 1, further comprising:
an energetic material located inside the body and configured to break the body into parts.

9. The ball of claim 1, wherein the ball is in contact with a frac plug.

10. The ball of claim 1, wherein the predetermined code is an electromagnetic field.

11. A system for sealing a stage in a well, the system comprising:
a frac plug located inside the well and having a through port;
a ball seated at an upstream end of the through port and sealing the frac plug;
a first actuation mechanism located in a body of the ball and configured to break the body into parts; and
a downhole tool located outside of the ball and configured to actuate the first actuation mechanism with a predetermined code,
wherein the downhole tool extends from a surface of the well.

12. The system of claim 11, wherein the ball includes a ball sensor and the downhole tool includes a tool sensor.

13. The system of claim 12, wherein the tool sensor triggers the ball sensor.

14. The system of claim 12, wherein the first actuation mechanism is actuated by a signal from the ball sensor, after the ball sensor has received a command from the tool sensor.

15. The system of claim 12, wherein each of the ball sensor and the tool sensor is a radio-frequency sensor.

16. The system of claim 12, wherein each of the ball sensor and the tool sensor is a pressure sensor.

17. The system of claim 12, wherein each of the ball sensor and the tool sensor is an optical sensor.

18. The system of claim 12, wherein each of the ball sensor and the tool sensor is an acoustic sensor.

19. The system of claim 11, wherein the frac plug comprises a second actuation mechanism configured to break a body of the frac plug into pieces.

20. The system of claim 19, wherein the frac plug comprises a frac sensor configured to communicate with the tool sensor.

21. The system of claim 20, wherein the frac sensor is configured to actuate the second actuation mechanism.

22. The system of claim 11, wherein the downhole tool is a coiled tubing.

23. A method for actuating a ball and/or plug located in a well, the method comprising:
lowering within the well a downhole tool having a tool sensor, until adjacent to the ball or the plug, wherein the tool sensor is outside the ball and wherein the downhole tool extends from a surface of the well;
actuating the tool sensor of the downhole tool;
sending a signal from the tool sensor to a corresponding sensor that is located on the ball or on the plug;
in response to the signal, actuating an actuation mechanism of the ball or the plug; and
breaking the ball or the plug into parts.

24. The method of claim 23, wherein the ball includes a ball sensor and the plug includes a plug sensor.

25. The method of claim 24, wherein the ball includes a first actuation mechanism and the plug includes a second actuation mechanism.

26. The method of claim 25, wherein the first actuation mechanism is configured to be actuated by a signal from the ball sensor.

27. The method of claim 24, wherein each of the ball sensor and the tool sensor is a radio-frequency sensor.

28. The method of claim 24, wherein each of the ball sensor and the tool sensor is a pressure sensor.

29. The method of claim 24, wherein each of the ball sensor and the tool sensor is an optical sensor.

30. The method of claim 24, wherein each of the ball sensor and the tool sensor is an acoustic sensor.

31. The method of claim 24, wherein the frac sensor is configured to actuate the second actuation mechanism.

32. The method of claim 23, wherein the downhole tool is a coiled tubing.

33. A ball for sealing a plug in a well, the ball comprising:
a body;
an actuation mechanism located inside the body and configured to break the body into parts; and
a sensor connected to the actuation mechanism and configured to detect, during a flowback stage, a presence of a base located outside the body,
wherein the base is mounted on another plug, which is located upstream the plug and the body.

34. The ball of claim 33, wherein the presence of the base actuates an energetic material of the actuation mechanism.

* * * * *